US008928493B2

(12) United States Patent
Mantalvanos

(10) Patent No.: US 8,928,493 B2
(45) Date of Patent: Jan. 6, 2015

(54) TRAFFIC SIGNAL CONTROL SYSTEM AND METHOD

(75) Inventor: Martin Mantalvanos, Dublin (IE)

(73) Assignee: Road Safety Management Ltd., Straffan (IE)

( * ) Notice: Subject to any disclaimer, the term of this patent is extended or adjusted under 35 U.S.C. 154(b) by 120 days.

(21) Appl. No.: 13/496,260

(22) PCT Filed: Sep. 16, 2010

(86) PCT No.: PCT/EP2010/063654

§ 371 (c)(1),
(2), (4) Date: Oct. 23, 2012

(87) PCT Pub. No.: WO2011/033042

PCT Pub. Date: Mar. 24, 2011

(65) Prior Publication Data

US 2013/0099942 A1 Apr. 25, 2013

(30) Foreign Application Priority Data

Sep. 16, 2009 (GB) ..... 0916204.1

(51) Int. Cl.
*G08G 1/07* (2006.01)

(52) U.S. Cl.
USPC ..... 340/910; 340/905; 340/909

(58) Field of Classification Search
CPC ..... G08G 1/00; G08G 1/07; G08G 1/08; G08G 1/081; G08G 1/082; G08G 1/083
USPC ..... 340/905, 906, 907, 909, 910, 915, 917, 340/919, 933; 348/143, 149
See application file for complete search history.

(56) References Cited

U.S. PATENT DOCUMENTS 4,257,029 A * 3/1981 Stevens ..... 340/915
5,357,436 A 10/1994 Chiu
5,696,502 A * 12/1997 Busch et al. ..... 340/905
6,317,058 B1 11/2001 Lemelson et al.
6,339,383 B1 * 1/2002 Kobayashi et al. ..... 340/907
(Continued)

FOREIGN PATENT DOCUMENTS

NL 1018875 C2 3/2003
WO 97/34274 A1 9/1997
WO 01/86359 A2 11/2001

OTHER PUBLICATIONS

Written Opinion of the International Searching Authority for PCT/EP2010/063654, mailed on Dec. 28, 2010, 8 pgs.

*Primary Examiner* — Van T. Trieu
(74) *Attorney, Agent, or Firm* — K&L Gates LLP

(57) ABSTRACT

The invention relates to a traffic signal control system for controlling a plurality of signal junctions comprising a signal group oriented multi-agent control scheme, each agent operates independently and represents one or more traffic signals at a signal junction; means for each agent for determining traffic conditions at its signal junction and traffic conditions at neighboring agents; and means for applying fuzzy logic in signal control operations, wherein signal control operation is based on traffic conditions at each agent and one or more neighboring agents, such that the control operation is distributed to each agent to control each of said plurality of signal junctions. An advantage of the system is that this approach in combining the flexible signal group control with the artificial intelligence of fuzzy logic dynamic control is achieved. The operation of the control system is based on detector data input, that is refined to real time traffic situation model. Through the traffic model, the decision part of the system (fuzzy logic) is observing the traffic situation in the whole intersection. The signal control operation is based on signal group orientation, in which the control operation is distributed to several signal group agents.

14 Claims, 6 Drawing Sheets

(56) References Cited

U.S. PATENT DOCUMENTS 6,617,981 B2 * 9/2003 Basinger ..... 340/909
2007/0069920 A1 * 3/2007 Hakki et al. ..... 340/907
2009/0256911 A1 * 10/2009 Hakki et al. ..... 348/149
2010/0245568 A1 * 9/2010 Wike et al. ..... 348/143

* cited by examiner

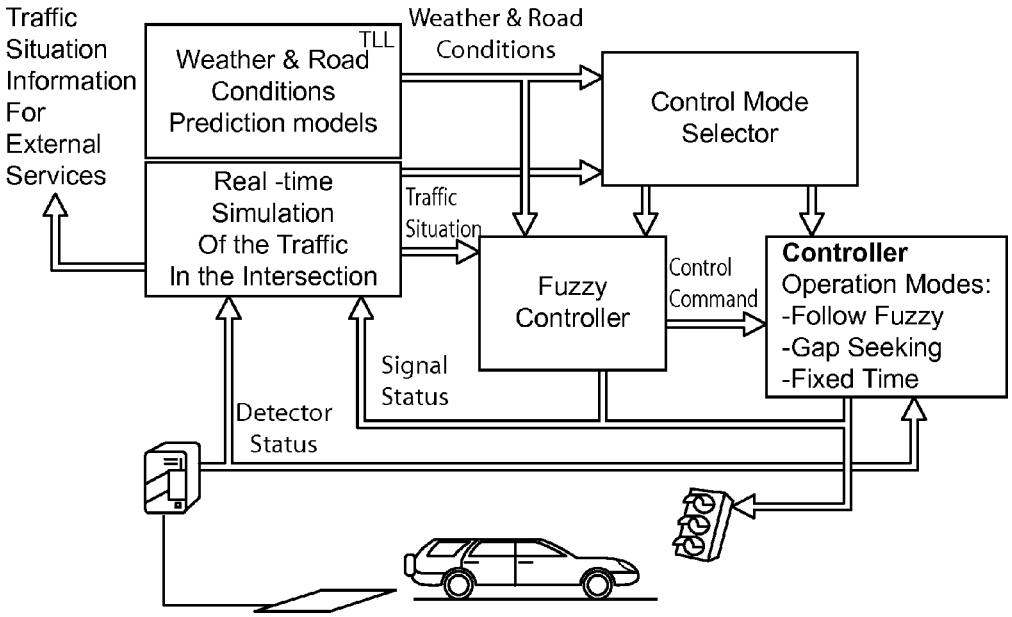
Figiure 11

TRAFFIC SIGNAL CONTROL SYSTEM AND METHOD

CROSS REFERENCE TO RELATED APPLICATIONS

This application is a national phase application under 35 U.S.C. §371 of International Application No. PCT/EP2010/063654, filed on Sep. 16, 2010, which claims priority to and the benefit of GB Patent Application No. 0916204.1, filed on Sep. 16, 2009, the entire disclosures of each of which are incorporated by reference herein.

FIELD OF THE INVENTION

The present invention relates to traffic signal control method and system. In particular the invention relates an intelligent multi-agent traffic signal control system using fuzzy logic.

BACKGROUND TO THE INVENTION

The goal of traffic management systems is to efficiently manage existing transportation resources in response to dynamic traffic conditions. Traffic management tasks are fairly simple, use roads to their optimal capacity. For the past twenty five years the idea of a non-human based system managing traffic has been a goal of the traffic industry. The basis behind it being that a junction or central controller can manage traffic flow significantly reducing congestion and traffic jams within a city and increasing traffic flow.

The inability of existing road networks to cope with increased demand has been identified as one of the most problematic and pressing infrastructure issues. Presently a large number of signal controlled junctions are still controlled by systems based on fixed timed schedules. In more sophisticated systems, remote human intervention is possible so that a person can watch a camera and change the timing schedules from a traffic control centre according to different traffic situations. The first system relies on the assumption that generally the traffic conditions remain relatively constant. The latter system requires continuous human control and prediction. Additionally adaptive urban traffic control systems (UTCS) can be used. Two examples of the UTC-systems are known, namely the SCATS and the SCOOT system.

Many metropolitan areas have created traffic management centres (TMC) with closed-circuit television (CCTV) cameras, traffic and weather sensors, electronic variable message signs (VMS), traffic signals, and ramp meters to monitor and manage traffic flow on streets and motorways, however most of these still rely on data being given to a person who can make a decision based on that data.

The modern goal is to create a system that can hand this responsibly over to an automated traffic signal control system. Typically a central computer is used to generate timing schedules off-line based on average traffic conditions for a specific time of day. The schedules are then downloaded to local controllers at the appropriate time of day. Timing schedules are typically obtained either by maximizing the bandwidth on arterial streets or by minimizing a disutility index, such as a measurement of stops and delays.

The off-line, optimization approach has limitations in responding to unpredictable changes in traffic demand. These systems can respond to changing traffic demand by performing incremental optimizations at the local level. The most notable of these are the "Sydney Coordinated Adaptive Traffic System" (SCATS), developed in Australia, and the "Split Cycle and Offset Optimizing Technique" (SCOOT), developed in England. SCATS is installed in several major cities in Australia, New Zealand, and Asia. SCOOT is installed in a number of other cities.

Both SCATS and SCOOT are complicated, real-time systems that manage large traffic signal networks. These systems provide predetermined, incremental changes in the cycle time, phase split, and offset of traffic signals in their networks. Cycle time is defined as the duration for completing all phases of a signal. Phase split is the division of the cycle time into periods of green signals for the competing approaches. Offset is the time relationship between the start of each phase among adjacent intersections.

SCATS organizes groups of intersections into subsystems. Each subsystem contains only one critical intersection whose timing parameters are adjusted directly by a regional computer based on the average prevailing traffic condition for the area. The basic traffic data used in SCATS is the "degree of saturation," defined as the ratio of the effectively used green time to the total available green time. Cycle time for the critical intersection is adjusted to maintain a high degree of saturation for the lane with the greatest degree of saturation. Phase split for the critical intersection is adjusted to maintain equal degrees of saturation on competing approaches. All other intersections in the subsystem are coordinated with the critical intersection, sharing a common cycle time and having coordinated phase split and offset. Subsystems may be linked to form a larger coordinated system when their cycle times are nearly equal. At the lower level, each intersection can independently shorten or omit a particular phase based on local traffic demand. However, any time saved by ending a phase early must be added to the subsequent phase to maintain a common cycle time among all intersections in the subsystem. The offsets among the intersections in a subsystem are selected to eliminate stops in the direction of dominant traffic flow.

SCOOT uses real-time traffic data collected by sensors located far upstream from a signal to generate traffic flow models, called "cyclic flow profiles." Cyclic flow profiles are used to estimate how many vehicles will arrive at a downstream signal when that signal is red. This estimate provides predictions of queue size for different hypothetical changes in the signal timing parameters. The objective of SCOOT is to minimize the sum of the average queues in an area. A few seconds before every phase change, SCOOT uses the flow model to determine whether the phase change should be advanced by 4 seconds, remain unaltered, or be retarded by 4 seconds. Once each cycle, SCOOT also determines whether the offset should be advanced by 4 seconds, remain unaltered, or be retarded by 4 seconds. Once every few minutes, SCOOT determines whether the common cycle time of all intersections grouped in a subsystem should be incremented, unchanged, or decremented by a few seconds. Thus, SCOOT changes its timing parameters in predetermined, fixed increments to optimize an explicit performance objective.

Because prior traffic signal systems that rely on centralized or regional computer control do not respond well to unpredicted changes in traffic demand and become ineffective when the central or regional computer fails, there is a need for an adaptive, serf-organizing, fault-tolerant traffic signal control system that is based on local traffic data and localized computer control.

U.S. Pat. No. 5,357,436, assigned to Rockwell International Cooperation, discloses a traffic signal network controlled by an adaptive, fuzzy logic based, distributed system of microprocessors. However a problem with this system is that it is complex to implement and operates on a staged process. A drawback with the Rockwell system is that the system operates on fixed stages in a single agent architecture. This results in a rigid system that does not provide any flexibility for dynamic traffic monitoring at individual traffic junctions. Other similar published patent literature suffer from the same problems include NL 1018875, WO97/34274 and U.S. Pat. No. 6,317,058.

An object of the present invention is therefore to provide a traffic management system and method to overcome the above mentioned problems.

SUMMARY OF THE INVENTION

According to the present invention there is provided, as set out in the appended claims, a traffic signal control system for controlling a plurality of signal junctions comprising:

- a signal group oriented multi-agent control scheme, each agent adapted to operate independently and represents one or more traffic signals at a signal junction;
- means for each agent for determining traffic conditions at its signal junction and traffic conditions at neighbouring agents; and
- means for applying fuzzy logic in signal control operations, wherein signal control operation is based on traffic conditions at each agent and one or more neighbouring agents, such that the control operation is distributed to each agent to control each of said plurality of signal junctions.

An advantage of the present invention is that the multi-agent approach in combining the flexible signal group control with the artificial intelligence of fuzzy logic provides a flexible dynamic control. The operation of the control system is based on detector data input, that is refined to real time traffic situation model. Through the traffic model, the decision part of the system (fuzzy logic) is observing the traffic situation in the whole intersection. The signal control operation is based on signal group orientation, in which the control operation is distributed to several signal group agents. The signal group oriented technique allows each traffic signal to operate individually within the limits given by safety requirements. Therefore there are no fixed stages but various phase pictures can exists depending on the traffic demand.

Each signal group agent is operating individually, negotiating with other signal groups about the signal timing. Due to the combination of the negotiation process each signal group is all the time aware of the traffic situations in each approach and lane of the whole intersection.

The actual decision making of the green extension time is made by applying fuzzy logic. With fuzzy logic it is possible to apply a decision process to many different types of inputs, which are not mathematically unit compact. It is also possible to define the traffic situations and signal control rules by words. In this way it is possible to mimic the human decision making i.e. the traffic policeman in the intersection.

In one embodiment each agent comprises means for calculating relevant queues and approaching vehicles in a particular direction based on timings to downstream agents, wherein the downstream agent sums the upstream vehicles with a given weight, such that when a threshold is reached indicating large volumes of traffic said agent provides priority access for said vehicles.

In one embodiment signalling information in said system is sent using UDP packet information.

In one embodiment said system comprises means for performing real-time traffic modelling at each junction.

In one embodiment said system comprises means for performing real-time traffic modelling comprises means for transmitting real-time traffic modelling data to a server.

In one embodiment the real-time traffic modelling data comprises visual data and numeric data at a junction.

In one embodiment the system comprises means for translating the visual data and numeric data into a 2D or 3D real time animation of the junction at a remote interface.

In one embodiment the numeric data comprises traffic performance data of travel times, delays, queues and stops.

In one embodiment the data is transmitted in raw mode and/or aggregated mode, wherein the aggregated mode collects average numbers for each signal junction for a given time frame and the raw mode sends one message per each vehicle trip.

In one embodiment each agent comprises remote access adapted to allow for maintenance and upgrading of each agent from a remote location.

In one embodiment each signal group agent controls the traffic signals at an individual junction.

In one embodiment detected data input at each signal junction is inputted into a real-time situation model to provide said control operation.

In one embodiment each agent comprises means for providing junction management to provide an active junction that can have continuously different phases that it can decide on, based on traffic flow and priorities.

In one embodiment the system comprises negotiation means such that each signal group is aware of each traffic situation for each approach route controlled by an agent.

In one embodiment the system comprises a standard PC connected to an existing signal controller, such that the controller comprises means for detecting data at a junction is turned into "slave" mode operation. The software can be installed into a typical PC which is connected to an existing signal controller in the field. The field controller has to be turned into a "slave" mode, that is collecting the detector data to the FITS-controller and just repeating the signal status set by the FITS-controller.

In one embodiment said system comprises means for providing priority to selected public transport vehicles at signalised junctions.

In one embodiment said control signals comprises XML instructions.

In another embodiment of the present invention there is provided a method of controlling a traffic signal control system for controlling a plurality of signal junctions comprising:

- providing a signal group oriented multi-agent control scheme, each agent operates independently and represents one or more traffic signals at a signal junction;
- determining traffic conditions at its signal junction and traffic conditions at neighbouring agents; and
- applying fuzzy logic in signal control operations, wherein signal control operation is based on traffic conditions at each agent and one or more neighbouring agents, such that the control operation is distributed to each agent to control each of said plurality of signal junctions.

There is also provided a computer program comprising program instructions for causing a computer program to carry out the above method which may be embodied on a record medium, carrier signal or read-only memory.

BRIEF DESCRIPTION OF THE DRAWINGS

The invention will be more clearly understood from the following description of an embodiment thereof, given by way of example only, with reference to the accompanying drawings, in which:—

FIG. 11 illustrates a flow chart for adjusting traffic signals based on weather and road conditions.

DETAILED DESCRIPTION OF THE DRAWINGS

Figure 1:
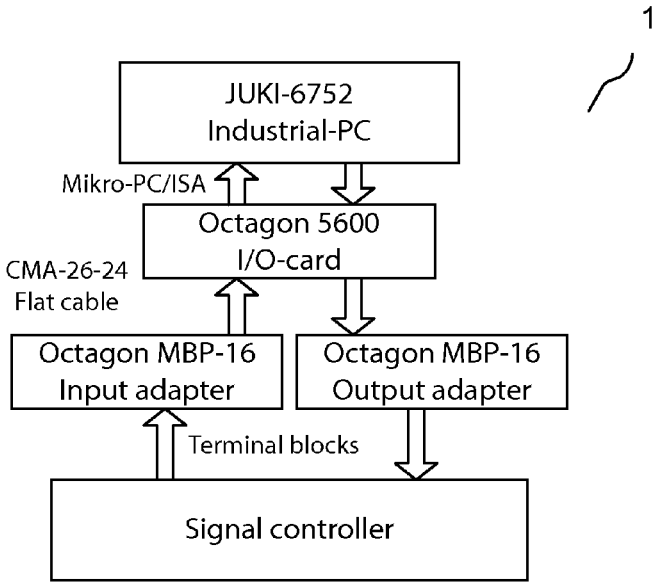
FIG. 1 illustrates a block diagram of an interface between a computer and a signal controller.

The invention provides a Fuzzy logic Integrated Traffic System (FITS) architecture. FIG. 1 illustrates a block diagram of an interface between a computer and a signal controller, indicated generally by the reference numeral 1. FITS is a decision based traffic control system which uses data from vehicle detectors in order to create a comprehensive state estimation of the prevailing traffic situation. This information is used by multiple fuzzy control agents in a distributed multi-agent architecture in order to control the timing and phasing of the traffic signal in a flexible way that reflects the ideas of the human traffic planner or a human traffic controller, for example a traffic policeman. Each agent operates independently and represents one or more traffic signals at a signal junction. The system provides a means for each agent for determining traffic conditions at its signal junction and traffic conditions of neighbouring agents. The traffic management system of the invention comprises a multi-agent architecture controlled by three components:

1) A fuzzy logic module
2) A simulator module
3) An interface module

Fuzzy Logic Module

Figure 2:
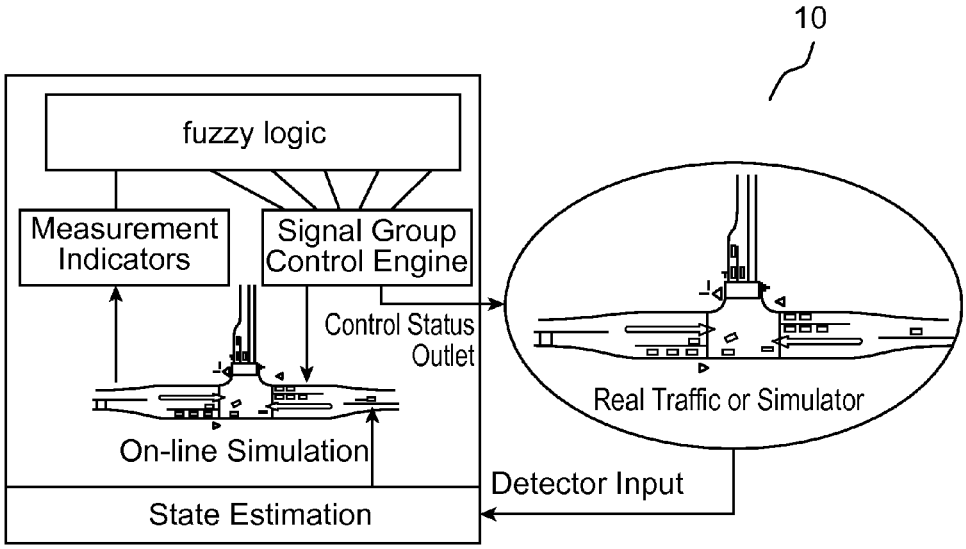
FIG. 2 illustrates fuzzy logic module according to one aspect of the invention.

FIG. 2 illustrates fuzzy logic module according to one aspect of the invention, indicated by the reference numeral 10. FITS reduces delay and congestion but also contains other traffic management facilities such as:

1) A facility to integrate active priority to buses (link to bus priority) with the common system. The system is designed to allow buses to be detected either by selective vehicle detectors or by an automatic vehicle location (AVL) system.
2) The system uses a decentralised (multi-agent) control strategy, where a signal head (signal group) operates individually, but in co-operation with other signal groups within the same junction.
3) The system can also involve the local controllers to communicate with other signal controllers as well as with a central computer. An important aspect of the system is the provision of priority to selected public transport vehicles at signalised junctions and improvements in mobility for private vehicles, subject to any delays necessary to accommodate priority vehicles.

Each agent uses a set of detectors to evaluate the traffic situation. Each agent can then make a decision to on how many cars to let through based on the number at each junction, the priority of a direction and data that it received from the other junctions. The agent makes it decisions and can send a message to the immediate or neighbouring junctions in its vicinity of its decision.

Figure 3:
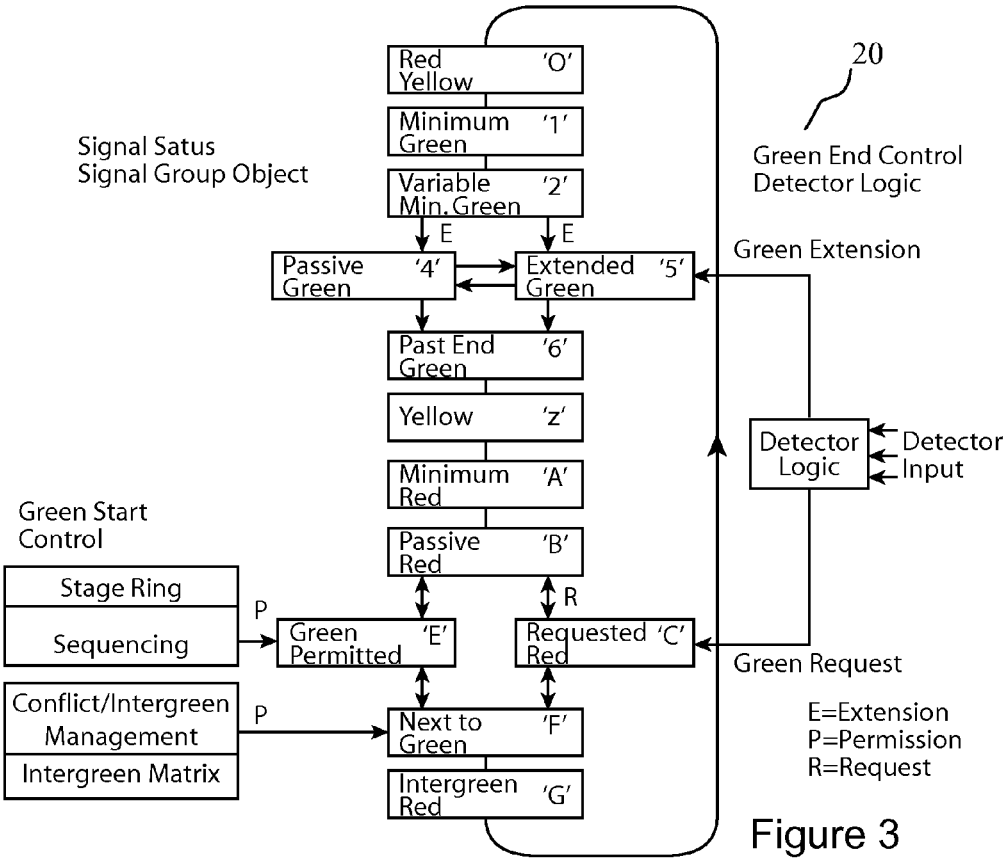
FIG. 3 illustrates a flow chart showing signal flow and control.

Several different control strategies have been tested in different isolated control environments to determine the performance of the system. FIG. 3 illustrates a flow chart showing signal flow and control, indicated by the reference numeral 20. This result of signalized pedestrian crossing indicates that the fuzzy control provides pedestrian friendly control keeping vehicle delay smaller than the conventional control. A new control algorithm for two-phase vehicle control was developed. According to tests performed, the application area of fuzzy control is wide. The results of multi-phase control indicated that the traditional extension principle still is a better traffic signal control mode in the area of very low traffic volumes.

Figure 4:
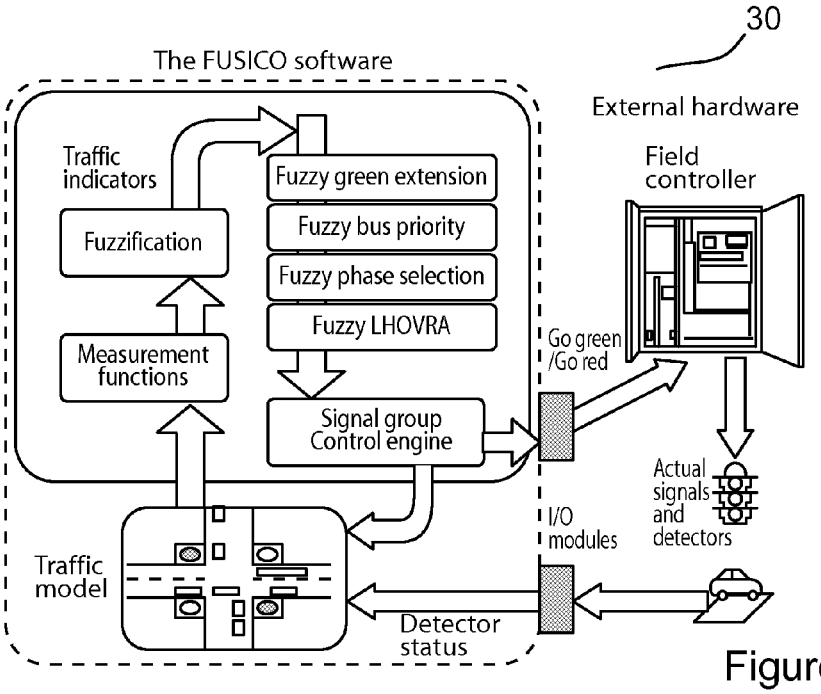
FIG. 4 illustrates fuzzy logic module according to one aspect of the invention.
Figure 5:
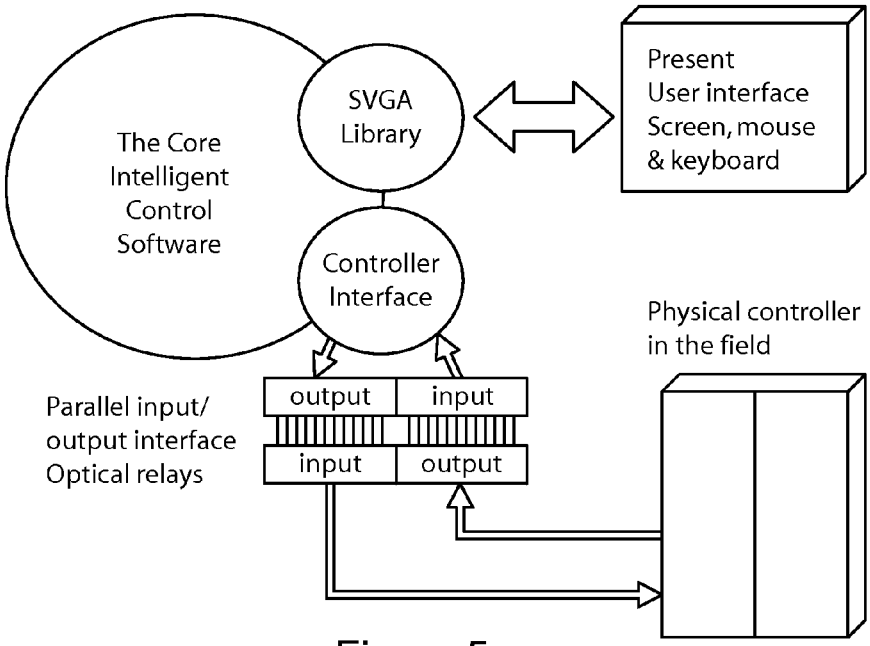
FIG. 5 illustrates interface between the intelligent control node and hardware.
Figure 6:
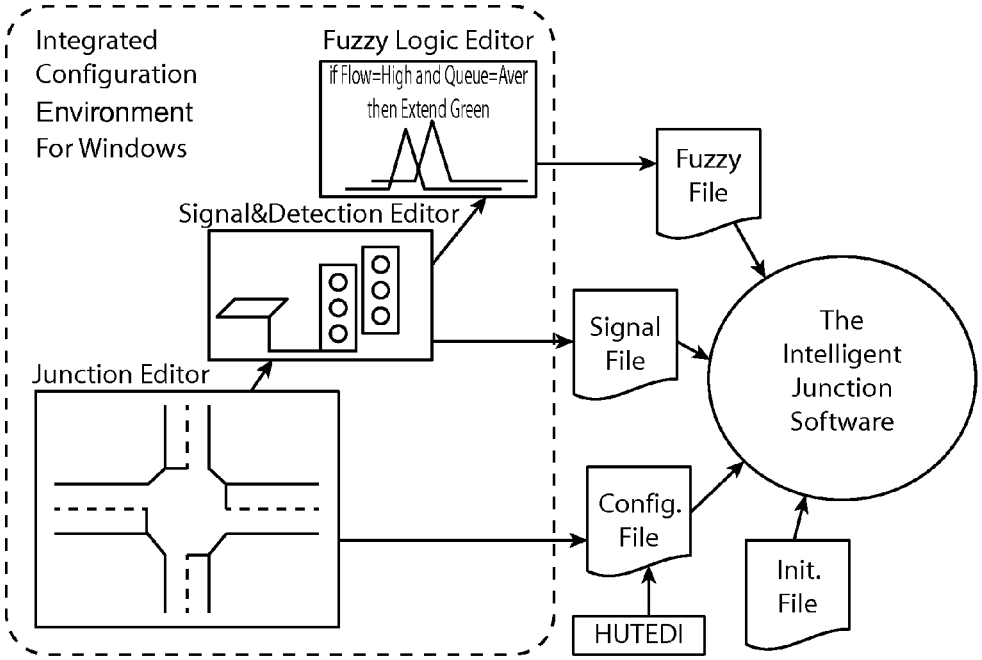
FIG. 6 illustrates user interface for setting up intelligent control node.

FIG. 4 illustrates fuzzy logic module according to one aspect of the invention that can be incorporated into each agent or controller, indicated generally by the reference numeral 30. An agent placed in the vicinity of the junction measures or detects data through a number of I/O modules. The detected date is fed into a traffic model for that junction and the fuzzy logic module. The data is processed and provides an adaptive control for the traffic light or lights at the junction taking account of data received from other agents, described in more detail below. In this way each agent acts as a dynamic local intelligent controller for each junction or intersection. The signal control operation is based on traffic conditions at each agent and one or more neighbouring agents, such that the control operation is distributed to each agent to control each of said plurality of signal junctions. The multilevel (traffic situation, phase selection and extension inference) fuzzy control makes adaptivity possible. This also means that the number of control programs can be smaller than in the traditional VA-control. The most significant difference between traditional and fuzzy control methods is that the extension principle in VA-control looks at only the green signal groups, but the fuzzy control analyzes also the queues behind the red signal groups. This multi-dimensionality, the opposite input-parameters and the free rule-base development enable multi-objective control. FIG. 5 illustrates one possible interface between the agent and hardware. FIG. 6 illustrates user interface for setting up an agent in the form of an intelligent control node at each junction.

Finally, the fuzzy control methods have been tested in several real intersections. The controller consists of traffic and control models, and it is justified that this kind of on-line simulation or simulation based traffic control is a working method.

The multi-agent system can offer a wide range of traffic management tools within a number of control modules, described in more detail below. The traffic manager has many tools available within the FITS system to manage traffic and meet local policy objectives such as:

1) Favouring particular routes or movements.
2) Delaying/preventing rat runs (short cuts through residential areas)
3) Managing gating traffic (management of the flow of traffic from smaller feed roads into main arterial roads) in certain areas of the city because of its efficient control and modelling of current conditions.
4) Buses can be given extra priority without unacceptable disruption to other traffic.

5) The city can engineer specific holding areas where queues should be relocated to in critical conditions, gating traffic entering the urban area to ensure efficient operation of critical, bottleneck links.
6) FITS can reduce vehicle emissions by reducing delays and congestion within the network, however it can be set to adjust the optimisation of the signal timings to minimise emissions and also provide estimations of harmful emissions within the controlled area. An additional software module is provided to compute the emissions. Carbon dioxide emissions correlate strongly with energy consumption, and are dependent on overall efficiency. Variability in other emissions, like nitric- and nitrous oxides is largely the result of the amount of acceleration. In urban traffic, the main cause of accelerations are stops at intersections and stop-and-go traffic as a result of congestion.
7) The real-time simulation system models the queues, waiting times and stops at intersections, so it can also estimate the time for cars spent in the various travel-modes: cruising, accelerating, decelerating, idling and stop-and-go. This data can be used to estimate emissions and pollution.

Real-Time Simulation Module

The FITS system controls the real-time simulator. The system collects data from each junction and feeds the results into an integrated server. The speed of FITS, twenty simulation updates per second, means it is possible to provide an accurate real time model of what the traffic situation is. In addition, the system can detect more subtle changes in the traffic and over time give a more accurate view of behavioural patterns allowing a city to do more. The real time traffic simulation model can be animated remotely in 2 or 3D modes. FITS reads the states of all available detectors and uses this information to update a real-time traffic simulation model typically some 20 times per second.

The present signal group controllers do not model the traffic situations and therefore they cannot send data about the traffic performance. However, the FITS-system maintains a real-time simulation model, which both numerically and visually represents the current traffic state of the junction and can be visualised remotely.

The data from the simulation model is transmitted to the FITS-server using a special dialect of XML called FITSML. Users can connect to the FITS-server to obtain the FITSML data stream and visualize it by using a set of various applications. The FITSVIEW-program reads the FITSML and redraws the junction and moves the vehicles producing a real-time animation. Another visualizer (3D) uses the same data stream, but visualizes the traffic in more elaborated 3D-environment.

Off-Line Simulation

Using a separate simulation system attached to the FITS system, allows the system to build up a models of the junction or area of several junctions controlled by the multi-agent architecture. This model can then be used to virtually test or model new aspects in traffic planning, such as evaluating the effects of traffic reversal, rerouting or one way systems.

A simulation system can be set to continuously run scenarios of various situations within the controlled area, such as road closures and can suggest alternative routing of roads during such situations.

Interface

Figure 7:
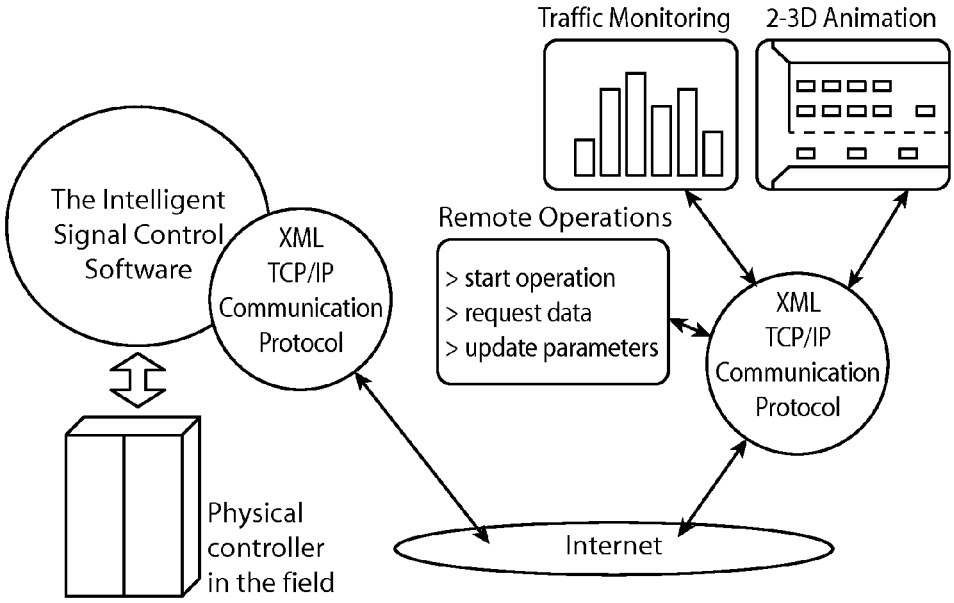
FIG. 7 illustrates on-line user interfaces showing traffic monitoring Information.

The on-line interface allows a visual and interactive view of FITS, as illustrated in FIG. 7. The interface is designed to incorporate the real time system. It is also designed to give a 3D view of the city and its tools allow for a macro and micro view of travel flow and travel time. Features include:

1) Detailed navigation networks thought-out a large geographical area, for example linked to sat-navigation for traffic display and city route planning.
2) Measurement of environmental impacts such as noise and pollutants. FITS can comprise a pollution reader that detects the level of pollution at a given junction and adjust the timing accordingly to reduce pollution levels
3) Tailor-made user interfaces adapted to specific needs a. Public transport
   b. Public
   c. Taxis
4) Can be linked to transit connections and management across the entire transportation network.
5) Simulated city planning—reroute roads and even entire networks.
6) Cost calculation down to a single vehicle for introduction of highway, city or individual road tolling.

The system provides a graphical configuration tool with the junction layout. The configuration tool is an integrated user-friendly tool for setting up the FITS traffic signal control. The user starts by drawing the junction and controller objects like detectors, signal groups and central controller and the input/output-object. The behaviour of the system is determined by the properties of the objects and by the connections between the objects. After creation of each object on the screen, user will assign the connections partly automatically, but some of them manually. The properties of the objects will be entered by opening a window, which allow user to see and modify the features of the selected object. When user presses "save" the program creates all the configuration files needed in the FITS-control. These files will be transferred to the actual controller in the field to be used by the FITS-signal control software.

It will be appreciated that each signal group looks for overall traffic situation rather than only it own approach. The present signal group oriented controller (VA) only look at the gaps between vehicles when the signal is green. The green is extended up to fixed maximum if no sufficient gap is found otherwise the green is terminated. In the FITS-system, however, each signal group is aware of the traffic situation of any other signal group. This means they can negotiate with each other about the overall optimal control strategy. The rules for this negotiation are defined by the fuzzy logic, which can be chosen by the user. By fuzzy logic the user describes signal control rules in a way that resembles the natural language. This makes the "programming" of the signal controllers more user-friendly and more traffic engineering oriented than in the present systems. With the fuzzy rules it is possible to implement the chosen traffic control policy for example to prioritize the main street, prioritizing public transport, minimizing emissions instead of delays etc.

Figure 8:
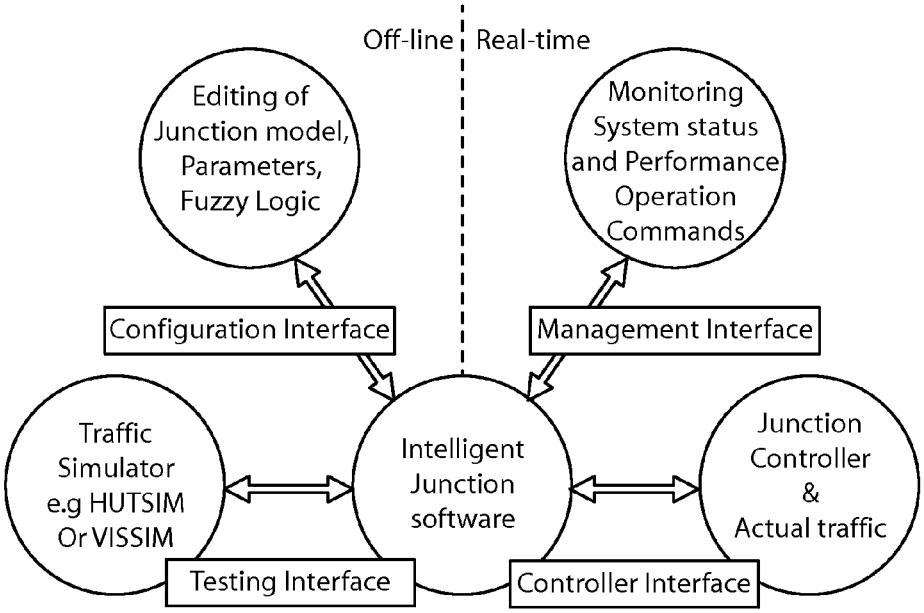
FIG. 8 illustrates an intelligent junction node for use in the management system.
Figure 9:
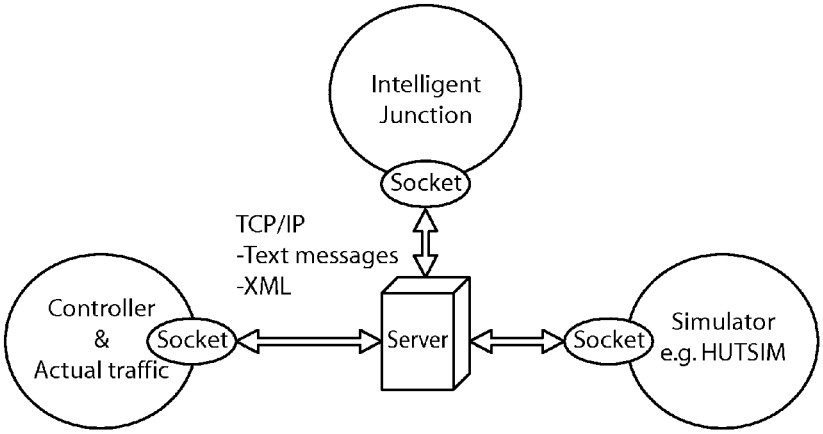
FIG. 9 illustrates a network implementation of the traffic management system.

The operation of the control system is based on detector data input, that is refined to realtime traffic situation model, as illustrated in FIGS. 8 and 9. Through the traffic model, the decision part of the system (fuzzy logic) is observing the traffic situation in the whole intersection. The signal control operation is based on signal group orientation, in which the control operation is distributed to several signal group agents. Each agent not only sends the visual data, but also the numeric indicators of the traffic performance. The most commonly used indicator required by the cities are the average travel times, travel speeds, delays, queues, stops etc. The data is sent in raw mode and/or aggregated mode. The aggregated mode collects the average numbers of each signal group per given time frame and sends the data to the server. The raw mode send one message per each vehicle trip and per each signal cycle. This allows more detail analysis of the variations and distributions of each variable as function of time or route.

All the numeric data is stored into a database, which has table for each data type coming from the fits-controller. Users can make queries to this database by using standard SQL-query language. Various types of user interfaces can be built based on the database to allow easy access to the data depending on the purpose (operating, planning, research, maintenance, travelers etc.). The interface to the database can be a web-browser or a dedicated program. Fuzzy coordination between the junctions can be based on platoon recognition, for example a Fuzzy bus priority gives priorities depending on the overall traffic situation. The fuzzy coordination applies the same principles as individual intersection control. Fuzzy extenders give green signal heads extensions according to queuing and approaching vehicles. In addition to normal vehicle counts, also vehicles queuing or moving in upstream intersections are taken into account. In practice these additional vehicles give more weight to "green wave" for strong vehicle streams (i.e. main streets).

Each individual intersection calculates relevant queues and approaching vehicles. The amount of vehicles is sent based on timings to downstream intersections. The downstream intersection then sums up the upstream vehicles (with given weight) whenever the decisions on extensions and the next phase is decided. The actual coordination is then taken into account only when there is enough vehicles in upstream intersection. If the level of traffic is low, the coordination is irrelevant and the intersections operate in "individual control" whereas bigger traffic streams in effect formulate green waves for the traffic. In other words each agent can calculate relevant queues and approaching vehicles in a particular direction based on timings to downstream agents, wherein the downstream agent sums the upstream vehicles with a given weight, such that when a threshold is reached indicating large volumes of traffic said agent provides priority access for said vehicles.

The actual signalling (i.e. sending the amount of upstream vehicles) is done by sending amount of vehicles by using UDP (User Datagram Protocol) packets containing the relevant information through the network.

Each signal group agent is operating individually, negotiating with other signal groups about the signal timing. Due to the combination of the negotiation process each signal group is all the time aware of the traffic situations in each approach and lane of the whole intersection. Each signal (also called as signal group) is operating individually as an agent controlled by the fuzzy logic. This offers use of quick and flexible phase pictures rather than fixed stages. The present signal controllers (for example in Scandinavia) only look at the incoming traffic of the currently green signal (the green time is simply terminated based on the gap between vehicles). In the FITS controller each signal group agent is watching the queue situation behind all the conflicting (red) signals and of course the incoming traffic flow. The comprehensive picture of the traffic situation is created by online simulation, which is modeling the queue formation. The decisions on extending or terminating the active green time is based on fuzzy rule sets. The rule sets control the negotiating between the signal groups (pressure of the queuing vehicles against the momentum of the moving vehicles in front of the green signal).

The actual decision making of the green extension time is made by applying fuzzy logic. With fuzzy logic it is possible to apply in decision process many different types of inputs, which are not mathematically unit compact. It is also possible to define the traffic situations and signal control rules by words. This way it is possible to mimic the human decision making i.e. an actual traffic policeman in the intersection.

It will be appreciated that new interfaces to the FITS system have been developed for configuring and monitoring of the FITS. The interface to the "slave" signal controller was adapted to provide a new operating system which is much more stable and offers more capabilities in communications for future needs, especially for XML-communication.

Figure 10:
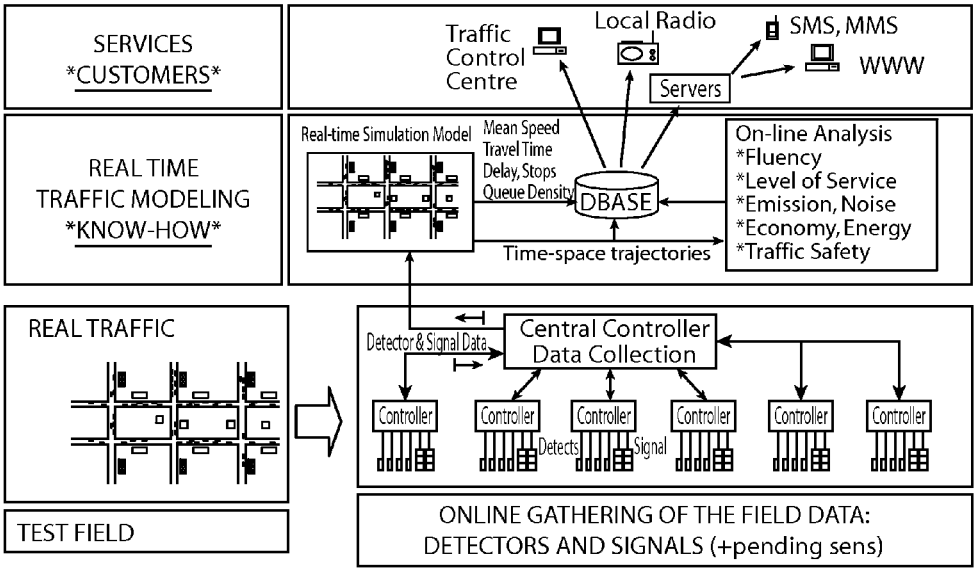
FIG. 10 illustrates an interface providing area signal control according to the invention.

The software is to be installed into an industrial PC that is connected to signal controller in the field. The field controller has to be turned into a "dummy" mode, that is collecting the detector data to the FITS-controller and repeating the signal status set by the FITS-controller. FIG. 10 illustrates an interface providing area signal control according to one aspect of the invention.

FIG. 11 illustrates a model for adjusting traffic signals based on weather and road conditions. The system of the invention can take account of various weather conditions to adapt the system in realtime to control the traffic nodes using a control mode selector and the Fuzzy controller.

It will be appreciated the invention provides simulation results from which a set of fuzzy rules and other parameters can be set to optimize the aspects, which are the most important in any particular junction. The fuzzy rules can be set to minimize the overall delay or favoring of a certain direction or a certain road users such as buses/trucks or bicycles/pedestrians.

It is desirable to provide a fast response to changes in traffic conditions to enable FITS to respond to variations in traffic demand on a cycle-by-cycle basis. FITS responds rapidly to changes in traffic, but not so rapidly that it is unstable; it avoids large fluctuations in control behaviour as a result of temporary changes in traffic patterns.

This approach creates a whole new style of junction management to provide 'dynamic functions', which mean no longer is a junction a set system that can have predictive, phases (red & green) but an active, junction that can have continuously different phases that it can decide on based on travel flow and priorities.

Another aspect of the FITS system is the provision of remote access to the controller in order to upgrade the software or parameters of the FITS at each junction. Remote access from user to the controller is needed in many cases to avoid the expensive maintenance on the street. With the FITS system all software components or configuration files can be upgraded or reloaded remotely. For safety reasons the access is very strictly limited to authorized personnel only. This is guaranteed by using virtual private network technology (VPN), which is also used in network banking providing a secure control environment.

A further aspect of the invention is the provision of an emission module to compute the energy consumption and various types of emissions. Modelling of traffic emissions in urban environment consists of two parts: (1) modelling the total emissions caused by traffic and (2) modelling the dispersion of these emissions. For the emissions not directly harmful to humans (e.g. CO2) only the first stage of the modelling is required, whereas for other emissions the dispersion models are needed for estimation of the exposure of the people in the vicinity of the emission source. Car traffic emissions are considered. Other sources of emissions (including non-traffic emissions) can be calculated by other means. However, these can be summed up to the car traffic emissions in order to get total emissions.

Different types of emissions that can be calculated include:

Nitrogen oxides (Nox)

Carbon monoxide (CO)

Carbon dioxide (CO2)

Energy consumption (indirect emissions)

Hydrocarbons (HC)

Sulphur oxide emissions (SO)

Micro particles (mp)

The method used in the emission calculation described here is based on vehicle trajectories. Each individual vehicle emits different amount of emissions depending on speed and acceleration (or deceleration) of the vehicle. Based on trajectories, the emissions can then be calculated by using information on the emissions under given acceleration (or deceleration) and speed.

Microscopic traffic emission calculation requires information on aspects of:

vehicle trajectories (speed and accelerations)

individual vehicle's emissions in given speed and acceleration (emission matrixes)

the mixture of various vehicle types within the traffic (cars, trucks, buses etc).

The FITS-system hereinbefore described can operate in two different modes namely the control or monitoring mode. When FITS operates on monitoring mode it is producing all the data described earlier but not affecting to the actual signal control. This mode is very useful by the cities who want to know how well their systems perform and what effect any modification really has on the traffic performance.

The control model includes the monitoring mode, but in addition also overrules any previous control of the traffic signals. The fuzzy logic is applied only in the control mode of The FITS. As well as giving priority to buses each agent can control traffic signals at each junction or intersection to give priority to an approaching emergency vehicle in certain situations.

In this specification the term 'agent' should be interpreted broadly and represents one or more traffic signals at a signal junction to provide a local control at each junction or intersection where a traffic light is positioned.

The embodiments in the invention described with reference to the drawings comprise a computer apparatus and/or processes performed in a computer apparatus. However, the invention also extends to computer programs, particularly computer programs stored on or in a carrier adapted to bring the invention into practice. The program may be in the form of source code, object code, or a code intermediate source and object code, such as in partially compiled form or in any other form suitable for use in the implementation of the method according to the invention. The carrier may comprise a storage medium such as ROM, e.g. CD ROM, or magnetic recording medium, e.g. a floppy disk or hard disk. The carrier may be an electrical or optical signal which may be transmitted via an electrical or an optical cable or by radio or other means.

Although the present invention has been described with respect to specific embodiments thereof, various changes and modifications can be carried out by those skilled in the art without departing from the scope of the invention. Therefore, it is intended that the present invention encompass such changes and modifications as fall within the scope of the appended claims.

In the specification the terms "comprise, comprises, comprised and comprising" or any variation thereof and the terms include, includes, included and including" or any variation thereof are considered to be totally interchangeable and they should all be afforded the widest possible interpretation and vice versa.

The invention is not limited to the embodiments hereinbefore described but may be varied in both construction and detail.

The invention claimed is:

1. A traffic signal control system for controlling a plurality of signal junctions comprising:

a signal group oriented multi-agent control scheme, each agent adapted to operate independently and represents one or more traffic signals at a signal junction;

means for each agent for determining traffic conditions at its signal junction and traffic conditions of neighbouring agents; and means for applying fuzzy logic in signal control operations, wherein signal control operation is based on traffic conditions at each agent and one or more neighbouring agents, such that the control operation is distributed to each agent to control each of said plurality of signal junctions, wherein the fuzzy logic is set based on a real-time model of the traffic situation at each of said plurality of signal junctions, wherein the modelling represents the current traffic state of each junction;

wherein the real-time modelling is performed by visual traffic data and numeric traffic data at each junction being transmitted to a remote server, and wherein the server further comprises means for translating the visual traffic data and numeric traffic data into a 2-Dimensional (2D) or 3-Dimensional (3D) real time model of the traffic at the junction.

2. The traffic signal control system as claimed in claim 1 wherein each agent comprises means for calculating relevant queues and approaching vehicles in a particular direction based on timings to downstream agents, wherein the downstream agent sums the upstream vehicles with a given weight, such that when a threshold is reached indicating large volumes of traffic said agent provides priority access for said vehicles.

3. The traffic signal control system as claimed in claim 1 wherein signalling information in said system is sent using User Datagram Protocol (UDP) packet information.

4. The traffic signal control system as claimed in claim 1 wherein the data is transmitted in raw mode and/or aggregated mode, wherein the aggregated mode collects average numbers for each signal junction for a given time frame and the raw mode sends one message per each vehicle trip.

5. The traffic signal control system as claimed in claim 1 wherein each agent comprises remote access adapted to allow for maintenance and upgrading of each agent from a remote location.

6. The traffic signal control system as claimed in claim 1 wherein each signal group agent controls the traffic signals at an individual junction.

7. The traffic signal control system as claimed in claim 1 wherein detected data input at each signal junction is inputted into a real-time situation model to provide said control operation.

8. The traffic signal control system as claimed in claim 1 wherein each agent comprises means for providing junction management to provide an active junction that can have continuously different phases that it can decide on, based on traffic flow and priorities.

9. The traffic signal control system as claimed in claim 1 comprising negotiation means such that each signal group is aware of each traffic situation for each approach route controlled by an agent.

10. The traffic signal control system as claimed in claim 1 comprising a personal computer PC connected to an existing signal controller, such that the controller comprises means for detecting data at a junction is turned into "slave" mode operation.

11. The traffic signal control system as claimed in claim 1 comprising means for providing priority to selected public transport vehicles at signalised junctions.

12. The traffic signal control system as claimed in claim 1 wherein in said control signals comprises Extensible Markup Language XML instructions.

13. A method of controlling a traffic signal control system for controlling a plurality of signal junctions comprising:

providing a signal group oriented multi-agent control scheme, each agent operates independently and represents one or more traffic signals at a signal junction;

determining traffic conditions at its signal junction and traffic conditions at neighbouring agents; and applying fuzzy logic in signal control operations, wherein signal control operation is based on traffic conditions at each agent and one or more neighbouring agents, such that the control operation is distributed to each agent to control each of said plurality of signal junctions, wherein that the fuzzy logic is set based on a real-time model of the traffic situation at each of said plurality of signal junctions, wherein the modelling represents the current traffic state of each junction;

wherein the real-time modelling is performed by visual traffic data and numeric traffic data at each junction being transmitted to a remote server, and wherein the server translates the visual traffic data and numeric traffic data into a 2-Dimensional (2D) or 3-Dimensional (3D) real time model of the traffic at the junction.

14. A computer program comprising program instructions for causing a computer to perform the method of claim 13.

* * * * *